US010690406B2

(12) United States Patent
Bernhardt et al.

(10) Patent No.: US 10,690,406 B2
(45) Date of Patent: Jun. 23, 2020

(54) METHOD AND DEVICE FOR LOW-TEMPERATURE COOLING/LIQUEFACTION

(75) Inventors: Jean-Marc Bernhardt, La Buisse (FR); Frederic Andrieu, St. Martin le Vinoux (FR); Franck Delcayre, Rives sur Fure (FR); Fabien Durand, Voreppe (FR); Veronique Grabie, Coublevie (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 767 days.

(21) Appl. No.: 13/515,117

(22) PCT Filed: Nov. 4, 2010

(86) PCT No.: PCT/FR2010/052363

§ 371 (c)(1),
(2), (4) Date: Jun. 11, 2012

(87) PCT Pub. No.: WO2011/070258

PCT Pub. Date: Jun. 16, 2011

(65) Prior Publication Data

US 2012/0279239 A1 Nov. 8, 2012

(30) Foreign Application Priority Data

Dec. 11, 2009 (FR) ..... 09 58859

(51) Int. Cl.
*F25J 1/00* (2006.01)
*F25J 1/02* (2006.01)

(52) U.S. Cl.
CPC ..... *F25J 1/025* (2013.01); *F25B 2500/22* (2013.01); *F25B 2500/221* (2013.01); *F25J 1/0007* (2013.01); *F25J 2230/20* (2013.01)

(58) Field of Classification Search
CPC .. F25J 1/0007; F25J 2230/20; F25B 2500/22; F25B 2500/221
(Continued)

(56) References Cited

U.S. PATENT DOCUMENTS 3,909,012 A * 9/1975 Denis ..... 277/432
3,919,854 A * 11/1975 Denis ..... 62/611
(Continued)

FOREIGN PATENT DOCUMENTS

DE 102005057986 6/2007
FR 2 066 461 8/1971
(Continued)

OTHER PUBLICATIONS

International Search Report for PCT/FR2010/052363, dated Feb. 9, 2011.
French Search Report for FR 0958859, dated Jul. 9, 2010.

*Primary Examiner* — David J Teitelbaum
(74) *Attorney, Agent, or Firm* — Christopher J. Cronin

(57) ABSTRACT

The invention relates to a method for low-temperature cooling/liquefaction of a working fluid, in particular a working fluid including helium or consisting of pure helium by means of a refrigerator/liquefier that includes a working circuit provided with a compressor station and a cold box. The refrigerator/liquefier subjects the working gas within the working circuit to a cycle that includes, in series: compressing the working fluid within the compressor station, cooling and decompressing the working fluid in the cold box, and heating the working fluid with a view to the return thereof to the compressor station. The compressor station includes one or more compression levels, each one using one or more compressors mounted on landings. The method is characterized in that the refrigerator includes a device for injecting a seal gas that is separate from the working fluid on at least one landing of the compressor(s) so as to form a gas seal that
(Continued)

guides the working fluid leaks, coming from the working circuit, to an area for recirculating and returning the fluid into the working circuit.

15 Claims, 3 Drawing Sheets

(58) Field of Classification Search
USPC ..... 62/4, 45.1–54.3, 532–545, 600–657
See application file for complete search history.

(56) References Cited

U.S. PATENT DOCUMENTS

| | | | | |
|---|---|---|---|---|
| 4,464,908 | A * | 8/1984 | Landerman et al. | 62/235.1 |
| 4,495,035 | A * | 1/1985 | Swearingen | 203/23 |
| 5,347,819 | A * | 9/1994 | Saji et al. | 62/610 |
| 6,427,483 | B1 * | 8/2002 | Rashad | F25B 9/006 62/613 |
| 2007/0037893 | A1 * | 2/2007 | Bradford | 518/726 |

FOREIGN PATENT DOCUMENTS

| | | |
|---|---|---|
| GB | 1 333 052 | 10/1973 |
| JP | 2004 028018 | 1/2004 |

* cited by examiner

METHOD AND DEVICE FOR LOW-TEMPERATURE COOLING/LIQUEFACTION

CROSS-REFERENCE TO RELATED APPLICATIONS

This application is a § 371 of International PCT Application PCT/FR2010/052363, filed Nov. 4, 2010, which claims § 119(a) foreign priority to French patent application 0958859, filed Dec. 11, 2009.

BACKGROUND

Field of the Invention

The present invention relates to a low-temperature cooling/liquefaction method and device.

The invention may notably relate to a liquefaction method and device and to a refrigeration method and device operating on helium.

The invention relates more specifically to a method for the low-temperature cooling/liquefaction of a working fluid, notably a working fluid containing helium or consisting of pure helium using a refrigerator/liquefier comprising a working circuit provided with a compression station and with a cold box. As best illustrated in FIG. 6, the refrigerator/liquefier subjects the working gas in the working circuit to a cycle comprising in series: a compression of the working fluid in the compression station, a cooling and an expansion of the working fluid in the cold box and a reheating of the working fluid so that it can be returned to the compression station, the compression station comprising one or several compression stages each using one or several compressors mounted on bearings.

Related Art

Refrigerators or liquefiers operating at low temperature (for example below 80K or below 20K) conventionally use a working fluid (for example helium) that is subjected to a working cycle comprising a compression, an expansion, a cooling and a reheating. These apparatuses in general require several stages for compressing the working gas. Each compression stage uses one or more compressor impellers. One example is a compressor of the centrifugal type.

Leaks of working gas in the compression station at the interface between the rotating parts and the fixed parts are unavoidable. Particularly when the working gas is helium, relatively significant leaks of gas are observed at the bearings that support the shafts of the compressor impellers. In order to limit this loss of relatively expensive working gas, it is known practice for the leakage at each bearing of each compression stage to be limited using members such as packings that form labyrinths for the gas, oil seals, floating ring seals, gas seals, etc.

Aside from the fact that these devices increase the cost of the installation, these known systems are not always best suited to cooler/liquefier technologies.

In addition, the oil present in the mechanism of the compression station must not be allowed to contaminate the working gas (by mixing with the helium or by adding moisture and/or light hydrocarbons). This is because such impurities introduced into the working circuit could create blockages at cryogenic temperatures and cause equipment breakage.

SUMMARY OF THE INVENTION

It is an object of the present invention to alleviate all or some of the abovementioned disadvantages of the prior art.

To this end, the method according to the invention, in other respects in accordance with the generic definition thereof given in the above preamble, is essentially characterized in that the refrigerator comprises a device for injecting a barrier gas distinct from the working fluid into at least one bearing of the compressor or compressors to form a gaseous barrier guiding the leaks of working fluid originating from the working circuit towards a zone for recycling and returning them to the working circuit.

Moreover, some embodiments of the invention may include one or several of the following features:

- the device for injecting the barrier gas forms a gaseous barrier to prevent the leaks of working fluid from passing towards at least one so-called contaminated zone of the compression station which zone is an oil-containing mechanism of the compression station or a zone which is not sealed with respect to the atmosphere,
- the barrier gas is injected into at least one bearing and at a pressure lower than the pressure of the working fluid in the working circuit at the compressor mounted on the said bearing,
- the barrier gas contains nitrogen or consists of pure nitrogen,
- the device for injecting the barrier gas comprises at least one barrier gas injection point and at least one outlet intended for collecting the mixture containing the injected barrier gas and the working fluid originating from the leak or leaks,
- the refrigerator/liquefier comprises a gas purification member having an inlet for gas that is to be purified and an outlet for purified gas, the outlet of the purification member being fluidically connected to the working circuit at the outlet of the compression station, and at least part of the mixture of barrier gas and of working fluid collected by the at least one outlet is reinjected into the inlet of the purification member so that it can be purified and then reinjected into the working circuit at the outlet of the compression station,
- the inlet of the purification member is fed with gas by a gas that is distinct from the working fluid of the circuit, that is to say that the working circuit is of the "open" type,
- at least part of the mixture of barrier gas and of working fluid collected by the at least one outlet is reinjected into the working circuit at the inlet of the compression station and/or at an intermediate compression stage and/or at the outlet of the compression station,
- the working cycle is said to be a "closed" cycle and comprises a gas purification member having an inlet for gas that is to be purified fed only with working gas originating from the working circuit, and an outlet for purified gas which feeds the cold box,
- the refrigerator/liquefier comprises a gas purification member having an inlet for gas that is to be purified and an outlet for purified gas, the outlet of the purification member being fluidically connected to the working circuit at the inlet to the compression station, and at least part of the mixture of barrier gas and of working fluid collected by the at least one outlet is reinjected into the inlet of the purification member so that it can be purified and then reinjected into the working circuit at the inlet of the compression station, the refrigerator/liquefier comprises a gas purification member having an inlet for gas that is to be purified and an outlet for purified gas, the outlet of the purification member being fluidically connected to the working circuit at an intermediate compression stage of the compression station and/or at the outlet of the compression station, and at least part of the mixture of barrier gas and of working fluid collected by the at least one outlet is reinjected into the inlet of the purification member so that it can be purified and then reinjected into the working circuit in or at the outlet of the compression station, at least part of the mixture of barrier gas and of working fluid collected by the at least one outlet is compressed before it is fed to the inlet of the purification member, the device comprises a member for purifying the mixture so as to separate impurities from the working gas and notably so as to remove the barrier gas from the mixture, the mixture being reinjected into the working circuit once it has passed through the purification member, the purification member comprises a separation system to remove impurities other than the working fluid such as the nitrogen from the gas, the purification member possibly comprises a system for compressing the purified gas or gas that is to be purified, the compressor or compressors are of the centrifugal type, the expansion turbine or turbines of the cold box are of the centrifugal type.

The invention also relates to a device for the low-temperature cooling/liquefaction of a working fluid containing helium or consisting of pure helium, the device comprising a working circuit provided with a compression station and with a cold box, the working circuit subjecting the working gas to a cycle comprising, in series: a compression of the working fluid in the compression station, a cooling and an expansion of the working fluid in the cold box and a reheating of the working fluid so that it can be returned to the compression station, the compression station comprising one or several compression stages each using one or several compressors mounted on bearings, characterized in that the refrigerator comprises a device for injecting a barrier gas distinct from the working fluid into at least one bearing of the compressor or compressors to form a gaseous barrier guiding the leaks of working fluid originating from the working circuit towards a zone for recycling and returning them to the working circuit.

According to other possible particular features:

the device for injecting the barrier gas comprises at least one barrier gas injection point and at least one outlet intended for collecting the mixture of injected barrier gas and working fluid originating from the leak or leaks, and the circuit comprises a pipe reinjecting the said mixture into the working circuit at the inlet of the compression station and/or at an intermediate compression stage of the compression station and/or at the outlet of the compression station;

the device comprises a member for purifying the mixture so as to separate impurities from the working gas and notably so as to remove the barrier gas from the mixture, the mixture being reinjected into the working circuit once it has passed through the purification member.

The invention may also relate to any alternative method or device comprising any combination of the features listed hereinabove or hereinbelow.

BRIEF DESCRIPTION OF THE FIGURES

Other specifics and advantages will become apparent from reading the following description which is given with reference to the figures in which.

DETAILED DESCRIPTION OF THE INVENTION

Figure 2:
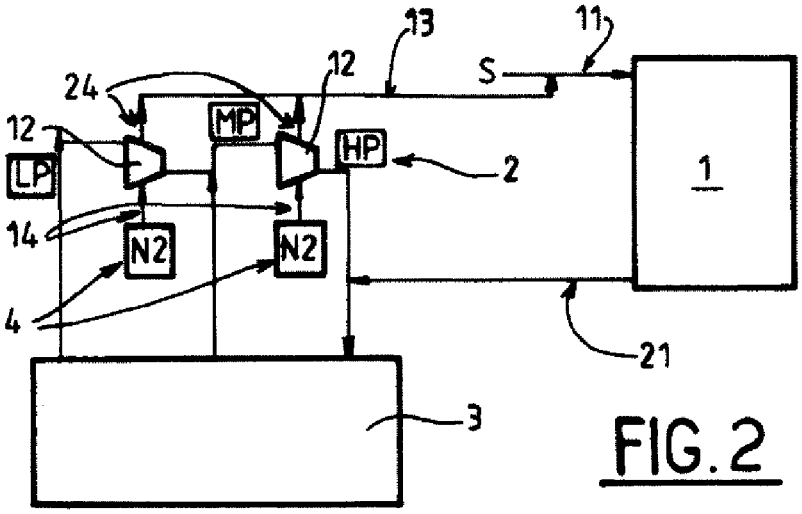
FIG. 2 is a schematic and partial view illustrating the structure and operation of a first embodiment of a refrigeration and/or liquefaction device according to the invention.

The example of a refrigerator/liquefier that has been depicted in FIG. 2 comprises, in the conventional way, a compression station 2 and a cold box 3.

The refrigerator/liquefier uses a working fluid with a low molar mass, and preferably predominantly or pure gaseous helium.

As depicted, this helium can be produced from a source S of helium-rich gas, for example from natural gas (or some other gas) which is purified by a purification unit 1 to supply helium to a working loop of the refrigerator/liquefier. The purification unit or member 1 contains, for example, a cryogenic gas separation system and/or two adsorbers arranged in parallel and operating in alternation on successive adsorption/regeneration cycles (of the PSA or TSA type, for example). The adsorbers are, for example, adsorbers of the active charcoal or silica-based type to remove impurities such as air, nitrogen.

What that means to say is that the system forms an open loop with a continuous influx of impurity.

In a conventional way, the working gas is compressed at ambient temperature in the compression station 2 using one or several compression stages 12 each using one or several compression machines, for example of the centrifugal compression type.

Thus, at the inlet to the compression station 2, the working gas arrives at a temperature close to ambient temperature and a pressure known as the low pressure LP comprised for example between 1 and 3 bar abs. At the outlet of the first compression stage 12, the working gas may then reach a pressure known as the medium pressure MP comprised for example between 3 and 8 bar abs.

At the outlet from the second compression stage 12, the working gas may then reach a pressure known as the high pressure HP comprised, for example, between 9 and 27 bar abs.

The compressed working gas is then admitted to a cold box 3 where it is cooled (or pre-cooled). Conventionally, during this (pre)cooling, energy (heat) is extracted from the working gas by expansion in one or more cryogenic turbine (s) and/or by exchange of heat with a cryogenic fluid such as nitrogen for example (for simplicity, the details of the cold box have not been depicted).

Once the working fluid has exchanged heat with a user, it may then return to the inlet of the compression station 2 (possibly being heated back up gradually in exchangers).

Figure 1:
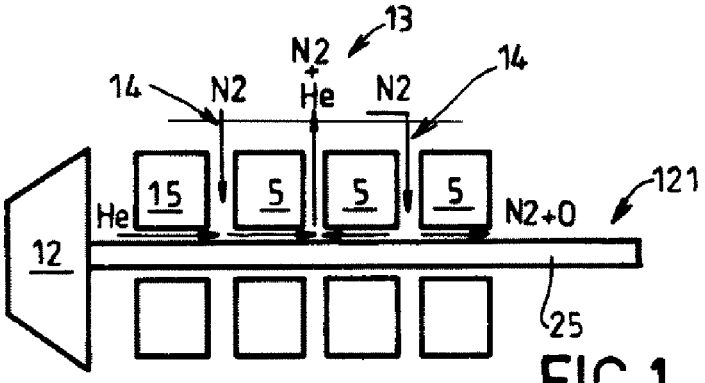
FIG. 1 depicts a schematic and partial view in cross section, illustrating one example of a compressor impeller mounted on bearings and comprising a device for collecting leaks of working gas according to the invention.

As depicted schematically in FIG. 1, leaks of working gas (He) occur particularly at the bearings 5 of the shaft 25 of the compression impellers 12.

For preference, one or more sealing devices 15 are arranged around the shaft 25 at each bearing 5, to limit the leaks of working gas originating from the working circuit (sealing devices of the "labyrinth" type, for example).

According to the invention, a barrier gas (nitrogen for example) is injected into the bearings 5 and the shaft 25 in order notably to isolate the working circuit from the mechanical part containing the oil O (gear mechanism and motor(s) of the compression station). What that means to say is that the barrier gas is designed to guide the leaks of working gas towards an outlet 24. For example, two barrier gas N2 injection points 14 may flank an outlet path 24 for the mixture containing the injected barrier gas N2 and the collected working gas He. For example, only the barrier gas N2 passes through the part in contact with the oil O or the atmosphere.

For preference, the pressure of the barrier gas injected is lower than the pressure of the working gas at the compression impeller concerned. In that way, any contamination of the working circuit by the barrier gas is avoided.

It will additionally be noted that a leak of working gas into the barrier gas is necessary for the correct functioning of this sealing zone (notably for the purposes of cooling the bearings).

At the outlet 24, the barrier gas contains a not-negligible amount of working gas (for example between 20 and 50 mol %). This mixture (He+N2) therefore leaves the bearings at a relatively low pressure comprised for example between 1 and 7 bar abs depending on the compression stage concerned.

FIG. 2 depicts a first embodiment which may, for example, relate to a liquefaction unit of an industrial type.

In this embodiment, the device comprises a gas purification member 1 having an inlet 11 for gas that is to be purified and an outlet 21 for purified gas. The outlet 21 of the purification member 1 is fluidically connected to the working circuit at the outlet of the compression station 2 or at a lower point in the cycle, dependent on its temperature.

The inlet 11 of the purification member 1 is fed with gas S from a source, for example is fed with a mixture of methane, nitrogen and helium. What that means to say is that the working gas in the working circuit is fed in open loop with gas that is less pure and undergoes a purification treatment.

In addition, the mixture of barrier gas and of working fluid collected by the outlets 24 described hereinabove is reinjected, via a pipe 13, at the inlet of the purification member 1 so that it can be purified then reinjected into the working circuit at the outlet of the compression station 2 or at a lower level in the cycle according to its temperature. What that means to say is that the barrier gas mixed with the working gas at the outlet 24 of the compressor system can be sent to the intake side of the purification member 1, for example to the intake side of a compressor that forms part of the purification member 1. Specifically, this collected mixture contains a nitrogen impurity level that may be compatible with operation of the purification member 1.

The working gas leakage rate is relatively low by comparison with the flow rate through the compressor of the purification unit. The level of sealing at each working gas compression stage 12 is therefore not critical. As a result, expensive sealing solutions 15 at the bearings can be avoided, in order to reduce the costs of the whole.

Figure 3:
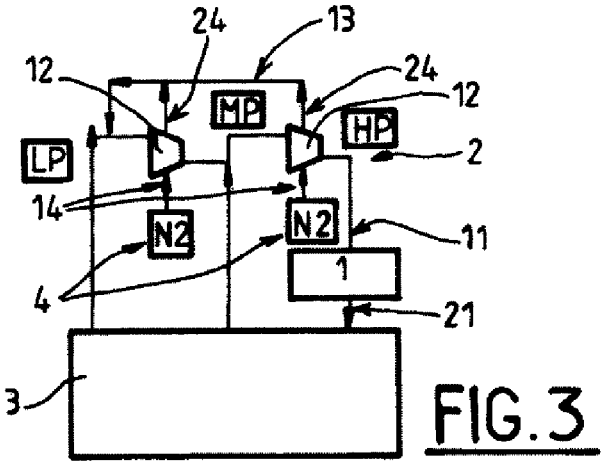
FIG. 3 depicts a schematic and partial view illustrating the structure and operation of a second embodiment of a refrigeration and/or liquefaction device according to the invention.

FIG. 3 depicts a second embodiment which may, for example, apply to a refrigeration unit. In FIG. 3 et seq. the elements which are identical to those described hereinabove are denoted by the same reference numerals and not described again. The device in FIG. 3 operates in this embodiment with a closed-loop working circuit (no supply of working gas via an external source).

The mixture of barrier gas and of working fluid collected by the outlets 24 is reinjected preferably directly at the inlet of the compression station 2 or of an intermediate stage of the compression station via a pipe 13. The mixture (barrier gas and working gas) recovered at the outlets 24 of the compressors 2 is therefore injected directly into the low-pressure circuit of the corresponding stage or of the compression station.

This recycling may generate contamination (barrier gas such as nitrogen) in the working circuit. These impurities are preferably removed in the working circuit. This removal can be carried out either by suitably rating the purification adsorbers conventionally provided in the cold box 3 or by adding an additional purification system 1. Thus, as depicted, the working circuit may optionally comprise a gas purification member 1 that has an inlet 11 for gas that is to be purified fed with working gas at the outlet of the compression station 2. The outlet 21 for purified gas from the purification member 1 feeds the cold box 3.

In this type of refrigeration unit, the working cycle of which is a closed loop cycle, losses of working gas at the bearings have to be relatively limited.

Figure 4:
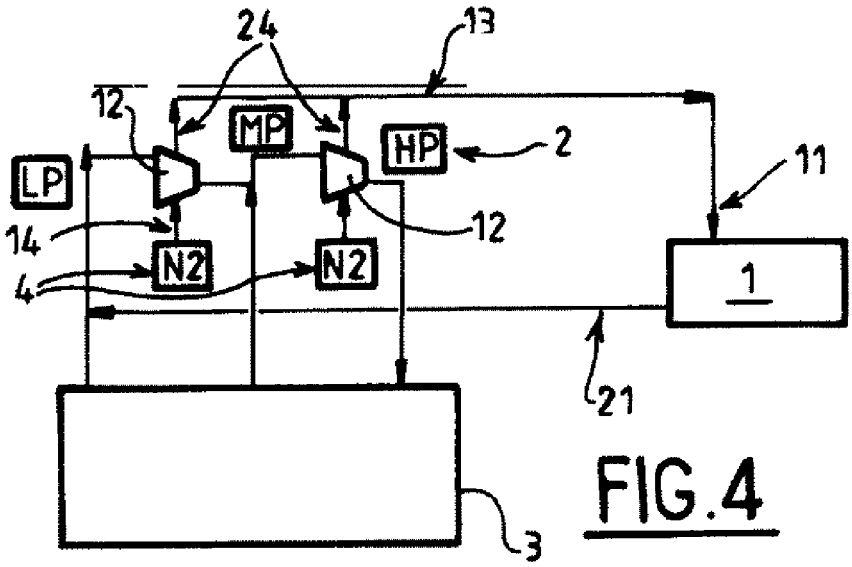
FIG. 4 depicts a schematic and partial view illustrating the structure and operation of a third embodiment of a refrigeration and/or liquefaction device according to the invention.

FIG. 4 depicts a third embodiment which may, for example, relate to a refrigeration unit. In this embodiment, the device operates with a closed-loop working circuit. The mixture of barrier gas and of working fluid collected by the outlets 24 is reinjected into the gas feed inlet 21 of a gas purification member 1. As before, the purification member 1 removes the impurities (removes all or some of the barrier gas, for example using nitrogen adsorbers of the TSA or PSA type if the barrier gas is nitrogen). What that means to say is that, in this case, the mixture of barrier gas (nitrogen) and of working gas (helium) recovered leaves the compressors 12 at a pressure that is high enough that it can be admitted directly into a conventional low-pressure purification member 1.

The purified gas outlet 21 of the purification member 1 is connected fluidically to the working circuit at the inlet of the compression station 2. What that means to say is that the working fluid is returned to the working circuit after purification.

Figure 5:
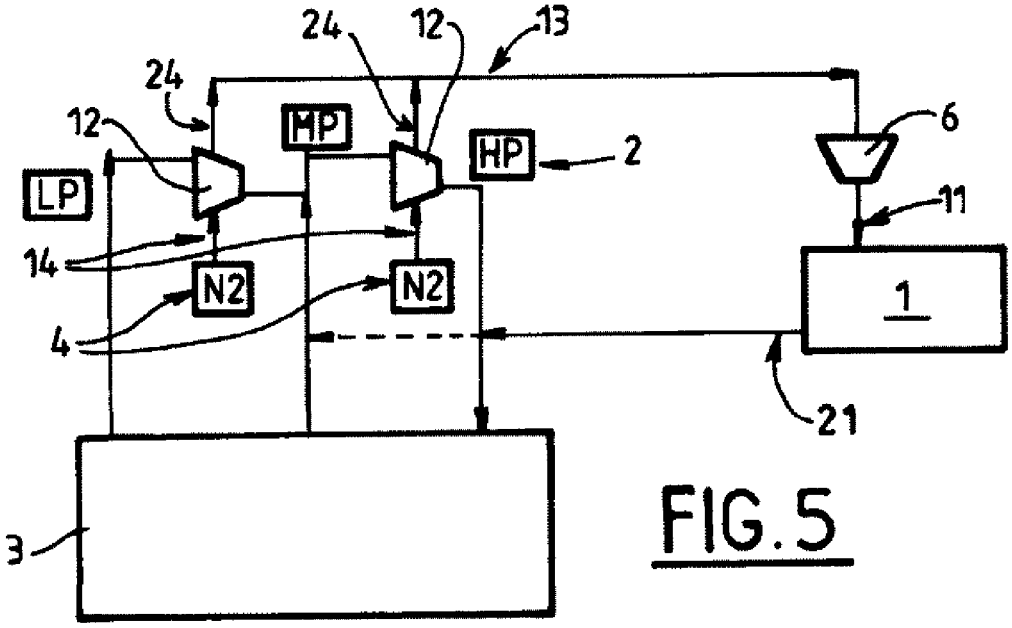
FIG. 5 depicts a schematic and partial view illustrating the structure and operation of a fourth embodiment of a refrigeration and/or liquefaction device according to the invention.
Figure 6:
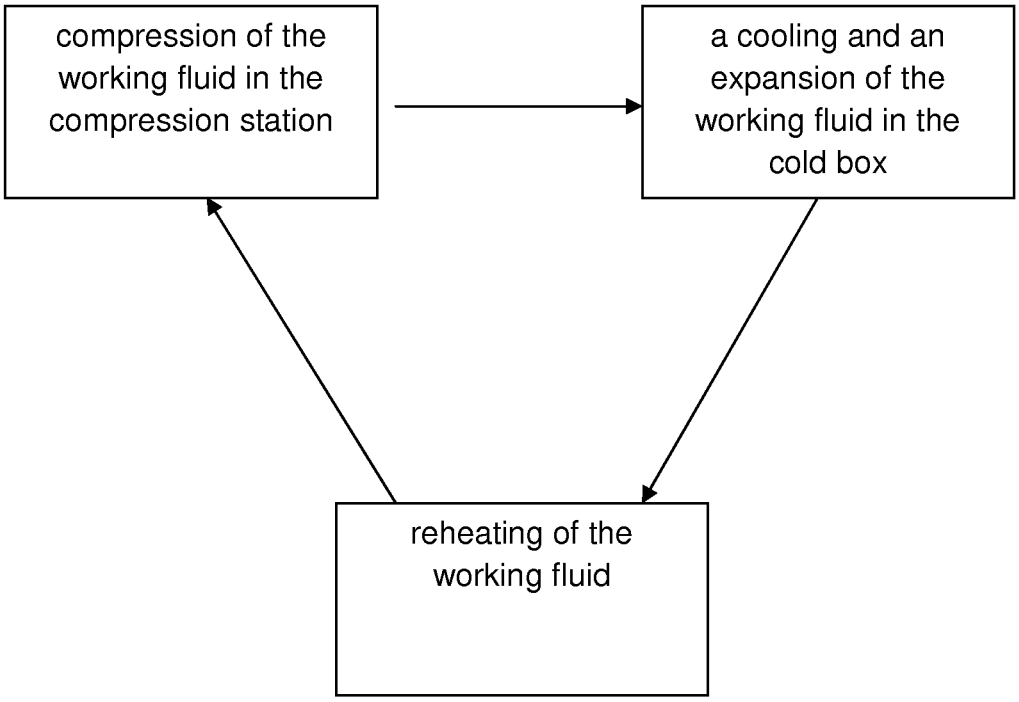
FIG. 6 depicts a flow chart of the cycle to which the working gas is subjected.

FIG. 5 depicts a fourth embodiment which may, for example, relate to a refrigeration unit. The device in this embodiment operates with a closed-loop working circuit. The mixture of barrier gas and of working fluid collected by all or some of the outlets 24 is reinjected into the gas feed inlet 21 of a gas purification member 1 via a compressor 6. What that means to say is that the mixture is compressed to a pressure which is high enough to allow high-pressure or medium-pressure purification thereof (pressures comprised for example between 3 and 27 bar abs). The medium-pressure or high-pressure purified working gas is reinjected at an intermediate compression stage of the compression station 2 and/or at the outlet of the compression station 2.

Of course, the invention is not restricted to the exemplary embodiments described hereinabove. For example, it is possible to envisage a device that falls somewhere between the embodiments of FIGS. 4 and 5. What that means to say is that when the mixture recovered is at a relatively low pressure, for example of between 1 and 3 bar (pressure in the impellers of the first compression stage), this mixture can be compressed to a medium pressure (of between 3 and 9 bar) before it is purified or reinjected directly into the circuit. When the mixture recovered is at a medium pressure, for example of between 3 and 15 bar (pressure in the impellers of an intermediate compression stage), this mixture can be sent to a medium-pressure purifier 1. In this way, the size of the recuperation compressor can be reduced.

Likewise, it is possible to envisage a device that falls somewhere between the embodiments of FIGS. 2 and 3. What that means to say is that when the mixture recovered is at a relatively low pressure, for example of between 1 and 3 bar (pressure in the impellers of the first compression stage), this mixture can be reinjected directly into the circuit at the inlet of the compression station.

In this case, in order to process the extra impurities, the internal adsorbers which are commonplace in the cold box 3 (for purifying working fluid) are preferably rated accordingly.

When the mixture recovered is at a medium pressure, for example of between 3 and 15 bar (pressure in the impellers of an intermediate compression stage), this mixture can be sent to a medium-pressure purifier 1.

It will therefore be readily understood that, while a simple and inexpensive structure, the invention allows any working fluid that has leaked to be recovered and recycled.

The invention makes it possible to control the extent to which the working gas is contaminated with a barrier gas. The working gas contaminated with the barrier gas is recovered and purified (in the cold box 3 and/or in an external purification member 1). This purification may be carried out at medium pressure after compression (or after an increase in pressure compatible with the sealing system). The purified gas can be reinjected into the circuit at the low-pressure level and/or at the medium-pressure level and/or at the high-pressure level.

The invention may notably be applied to any high-capacity liquefaction or refrigeration unit (operating on a helium or rare gas cycle).

The invention may notably also be applied to a hydrogen liquefier using helium as the working gas.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for low-temperature cooling/liquefaction of a working fluid using a refrigerator/liquefier comprising a working circuit provided with a compression station and with a cold box, comprising the step of using the refrigerator/liquefier, subjecting the working gas in the working circuit to a cycle comprising in series:

a compression of the working fluid in the compression station, the compression station comprising one or several compression stages each using one or several compressors mounted on bearings, the working gas arriving at an inlet of the compression station at ambient temperature;

a cooling and an expansion of the working fluid in the cold box; a reheating of the working fluid so that the working fluid can be returned to the compression station, wherein the refrigerator/liquefier comprises a barrier gas injection device adapted to inject a barrier gas, that is distinct from the working fluid, into at least one bearing of the one or several compression stages to form a gaseous barrier guiding leaks of the working fluid originating from the working circuit towards a zone for recycling and returning the leaks to the working circuit; and returning at least part of the leaks to the working circuit.

2. The method of claim 1, wherein the gaseous barrier prevents the leaks of working fluid from passing towards at least one contaminated zone of the compression station, the at least one contaminated zone being either an oil-containing mechanism of the compression station or not being sealed with respect to an atmosphere surrounding the at least one contaminated zone.

3. The method of claim 1, wherein the barrier gas is injected into said at least one bearing at a pressure lower than a pressure of the working fluid in the working circuit at the compressor that is mounted on said bearing.

4. The method of claim 1, wherein the barrier gas injection device comprises at least one barrier gas injection point and at least one outlet adapted to collect a mixture of the barrier gas and the leaks of the working fluid.

5. The method of claim 4, wherein:

the refrigerator/liquefier comprises a gas purification member having an inlet adapted to receive gas that is to be purified and an outlet for purified gas, the outlet of the purification member being fluidically connected to the working circuit at an outlet of the compression station; and at least part of the mixture of barrier gas and working fluid collected by the at least one outlet is reinjected into the inlet of the purification member so that the mixture can be purified and then reinjected into the working circuit at the outlet of the compression station.

6. The method of claim 5, wherein the working circuit is open in that the inlet of the purification member is fed with gas by a gas that is distinct from the working fluid of the circuit.

7. The method of claim 4, wherein at least part of the mixture of barrier gas and of working fluid collected by the at least one outlet of the barrier gas injection device is reinjected into the working circuit at a position selected from the group consisting of: an inlet of the compression station, an intermediate compression stage of the compression station, an outlet of the compression station, and combinations thereof.

8. The method of claim 7, wherein the cycle is a closed cycle in that the cycle comprises a gas purification member having an inlet that is fed only with working gas originating from the working circuit and an outlet which feeds the cold box.

9. The method of claim 4, wherein:

the refrigerator/liquefier comprises a gas purification member having an inlet for gas that is to be purified and an outlet for purified gas, the outlet of the purification member being fluidically connected to the working circuit at an inlet to the compression station; and at least part of a mixture of barrier gas and of working fluid collected by the at least one outlet of the barrier gas injection device is reinjected into the inlet of the purification member so that the at least part of a mixture of barrier gas and working fluid can be purified and then reinjected into the working circuit at an inlet of the compression station.

10. The method of claim 4, wherein;

the refrigerator/liquefier comprises a gas purification member having an inlet for gas that is to be purified and an outlet for purified gas, the outlet of the purification member being fluidically connected to the working circuit at an intermediate compression stage of the compression station and/or at an outlet of the compression station; and at least part of a mixture of barrier gas and of working fluid collected by the at least one outlet of the barrier gas injection device is reinjected into the inlet of the purification member so that the at least part of a mixture of barrier gas and working fluid can be purified and then reinjected into the working circuit in or at an outlet of the compression station.

11. The method of claim 10, wherein at least part of the mixture of barrier gas and of working fluid is compressed and fed to the inlet of the purification member after said compression.

12. The method of claim 1, wherein the working fluid comprises helium.

13. The method of claim 1, wherein the working fluid consists of pure helium.

14. The method of claim 1, wherein the barrier gas comprises nitrogen.

15. The method of claim 1, wherein the barrier gas consists of pure nitrogen.

* * * * *